US006820553B2

(12) United States Patent
Steffen et al.

(10) Patent No.: US 6,820,553 B2
(45) Date of Patent: Nov. 23, 2004

(54) HOLDER FOR AN ARTICLE TO BE DECORATED

(75) Inventors: Volker Steffen, Herford (DE); Markus Dauwe, Hilter (DE)

(73) Assignee: Werner Kammann Maschinenfabrik GmbH, Bünde (DE)

( * ) Notice: Subject to any disclaimer, the term of this patent is extended or adjusted under 35 U.S.C. 154(b) by 0 days.

(21) Appl. No.: 10/640,070

(22) Filed: Aug. 13, 2003

(65) Prior Publication Data

US 2004/0040453 A1 Mar. 4, 2004

(30) Foreign Application Priority Data

Aug. 28, 2002 (DE) ..... 102 39 391

(51) Int. Cl.[7] ..... B41F 15/26
(52) U.S. Cl. ..... 101/474; 269/280; 269/285
(58) Field of Search ..... 101/35, 41, 126, 101/474; 206/308.1; 269/274, 280, 285, 287, 303

(56) References Cited

U.S. PATENT DOCUMENTS 5,429,045 A 7/1995 Karlyn et al.
5,609,102 A * 3/1997 Rapp ..... 101/127.1
5,682,817 A * 11/1997 Iannuzi et al. ..... 101/126
5,797,688 A 8/1998 Wen
6,312,174 B1 11/2001 Drynkin et al.

FOREIGN PATENT DOCUMENTS

DE 198 10 128 A1 9/1999
EP 1 260 377 A2 11/2002

* cited by examiner

*Primary Examiner*—Stephen R. Funk
(74) *Attorney, Agent, or Firm*—Akin Gump Strauss Hauer & Feld, L.L.P.

(57) ABSTRACT

A holder is provided for holding an article in a machine for decorating articles, the holder including a base member, a format plate arranged releasably above the base member with an opening in the format plate for receiving the article, and an intermediate plate between the base member and the format plate. On its side facing the format plate the intermediate plate has a layer of soft material, such as a plastic film, to support the article. The intermediate plate and the format plate are easily releasably mounted on the base member. To replace the film, the intermediate plate with film can be removed from the holder and replaced by another intermediate plate carrying a fresh film.

20 Claims, 5 Drawing Sheets

46
16a
20
16c
54
18
26
24
38
16b
52
39
16d
36
16
14
58
36
10
62
12
36

10
44
16d 16a
54
18
14
46
58
12

Fig. 3
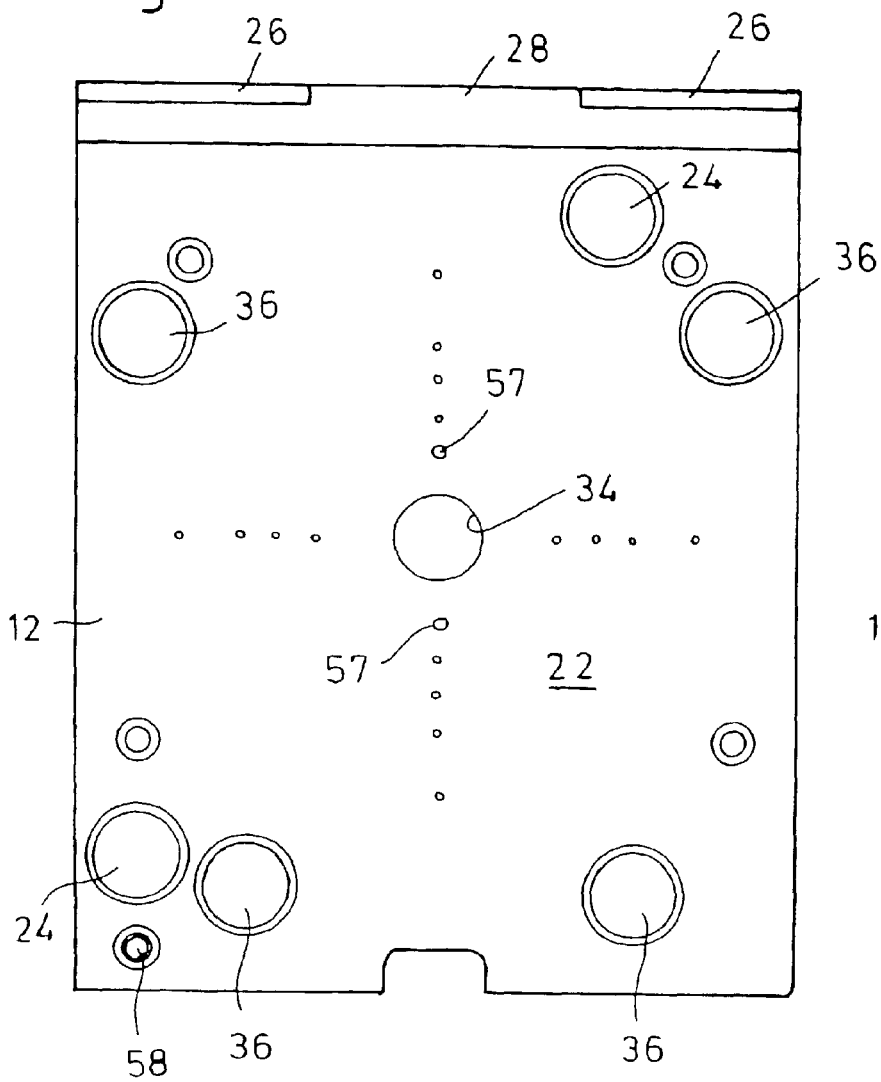
Fig. 4
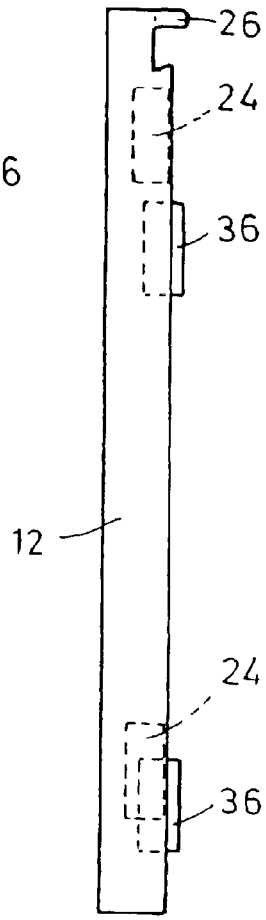
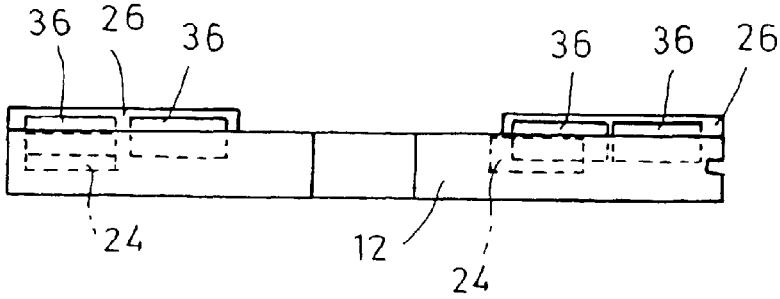
Fig. 5

HOLDER FOR AN ARTICLE TO BE DECORATED

BACKGROUND OF THE INVENTION

The invention concerns a holder for use in a machine for decorating articles, for holding such an article.

In this specification the term decorating is used broadly and thus embraces, for example, applying matter such as a pattern or graphics to an article or applying printing to an article.

One form of holder for holding an article in a machine for decorating articles includes a base member with a format plate arranged releasably over the base member and having an opening therein for receiving the article. Disposed on the base member is a thin layer of a soft material on which the article is disposed during a decoration procedure. The thin layer of soft material, which is generally a plastic film, is glued directly on to the base member. The plastic film thus forms a soft support which is intended to ensure that the surface of the article, being the surface by which the article rests on the holder, is not damaged, for example by scratching, in particular due to relatively coarse particles of dust or other smaller particles which may be deposited on the holder. Particles of that nature will occur in any space or room which does not satisfy special cleanliness conditions. The provision of the film thus ensures that, if a pressure which acts in a direction towards the holder is applied to the respective article in the holder, for example by virtue of the doctor of a screen printing mechanism or by an impression cylinder, any particles which are between the article and the holder and which are therefore on the film will be pressed into the soft film, so that this article and also subsequent articles to be held in the holder will not be scratched or otherwise damaged by such particles.

The films must be renewed frequently depending on the demands made in terms of the surface quality of the articles and the cleanliness of the air in the area around the printing mechanisms used for applying decoration to the respective articles. Renewal of the film may also be required, for example, when the format plate has to be changed when modifying the holder from dealing with articles of one format to articles of a different format. If the articles have sharp edges which occur, for example, in the form of burrs or other sharp projections arising in manufacture of the articles, for example, in an injection molding process, then the film will suffer from incisions of greater or lesser severity and possibly also other damage, in particular along the configuration for receiving the respective article, which is defined by the opening in the format plate. Such incisions and other damage mean that the same film cannot be used for articles of a larger format. It is to be assumed in this respect that, to simplify handling and inventory, irrespective of the size of the respective articles to be treated and thus the size of the receiving configuration for the individual article, as is defined by the opening in the format plate, films of the same size will be at least predominantly used.

In addition, the pressure loading applied to the article by a doctor or impression cylinder, which is transmitted through the article onto the film material which is supporting the article, means that this film material also experiences in the course of time, in spite of a degree of elasticity which is possibly inherent therein, a certain degree of permanent compression which normally excludes the use of the same film for an article of a larger format, as in that case, due to compression of the film, the film would be of differing thicknesses in the region in which an article of a smaller format has been accommodated.

One of the consequences involved in frequent changes in the films, as are required due to the above-described circumstances and possibly also other factors, is that the stoppage times of a machine used for decorating articles tend to be considerably increased and thus the productivity of such a machine is reduced. In the case of the above-discussed holder, the operation of changing the film involves first removing the format plate, whereupon the film is withdrawn from the base member which is generally also of a plate configuration. After that, the adhesive which has possibly remained on the base member has to be removed before a fresh film can then be fitted in properly oriented relationship to the base member. It will be appreciated that those steps require a considerable amount of time. In this case consideration is also to be given to the fact that, for example, modern screen printing or offset printing machines, by virtue of the level of productivity required, have a large number of holders, for example thirty two or thirty four, which means that a correspondingly large number of films has to be renewed. Examples of machines of that nature are disclosed in U.S. Pat. Nos. 5,899,143 and 6,082,256, to which reference is accordingly made for incorporation of the disclosure thereof into the content of this specification.

BRIEF SUMMARY OF THE INVENTION

An object of the present invention is to provide a holder for use in a machine for decorating articles, for holding such an article, which at least noticeably reduces disadvantages of the previous structures without a significant increase in expenditure to achieve that aim.

Another object of the present invention is to provide a holder for holding an article in a machine for decorating such articles, such as a printing machine, which is so designed that the machine stoppage times required to replace an article-supporting part of the holder can be substantially reduced.

A further object of the present invention is to provide a holder for holding an article in a machine for decorating such articles, which is of a simple structure to permit ready disassembly thereof for replacement of parts requiring renewal.

Still a further object of the invention is to provide a method of renewing in a holder for an article a part of the holder which is effective to support the article during a decoration or printing process.

Yet a further object of the invention is to provide an apparatus for decorating or printing on articles, including a holder for holding the article during decoration or printing in a secure manner without involving damage to the article.

In accordance with the principles of the present invention the foregoing and other objects are attained by a holder for holding an article in a machine for decorating articles, the holder comprising a base member with a format plate arranged releasably over the base member and having an opening therein for receiving an article to appropriately position it for the decoration procedure. An intermediate plate is arranged releasably between the base member and the format plate, and has a surface which is remote from the base member. A thin layer of soft material is carried on that remote surface of the intermediate plate, for suitably supporting the article thereon.

In accordance with a preferred feature of the holder of the invention the layer of soft material can be in the form of a self-adhesive film of plastic material, for example polyurethane. Depending on the configuration of the holder and in particular the opening formed therein for receiving the article, the film can also be of a multi-part nature, for example in such a way that a substantial part of the film covers over the actual receiving means for accommodating the article and serves as a support for the article, while at least a further portion of the film is disposed between the intermediate plate and the format plate thereabove.

So that the intermediate plate and the format plate can be rapidly fitted to the base member and also to allow them to be rapidly released therefrom, a preferred feature of the invention provides that the intermediate plate and the format plate can be fixed to the base member by a magnet arrangement. In that respect, different magnets mounted in the base member can be provided for the intermediate plate and the format plate, in such a way that the magnets holding the intermediate plate in position are substantially aligned with the upper boundary surface of the base member, whereas the magnets which serve to mount the format plate in position project with respect to the surface of the base member by an amount which approximately corresponds to the total of the thicknesses of the intermediate plate and optionally the film, the intermediate plate being provided with holes into which the magnets for holding the format plate extend, the upper boundary surface of the magnets, which is remote from the base member, being approximately aligned with the upper boundary surface formed by the surface of the film which is remote from the intermediate plate.

In accordance with another preferred feature of the invention, the holder may include means for moving the intermediate plate with the layer of soft material and the format plate positively into the correct position relative to the base member and fixing those components in that appropriate position.

Further objects, features and advantages of the invention will be apparent from the detailed description of the invention and of a preferred embodiment below.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIG. 3 is a plan view of the base member of the holder of FIGS. 1 and 2;

FIG. 4 is a side view of the base member of FIG. 3;

FIG. 5 is a front view of the base member of FIG. 3;

DETAILED DESCRIPTION OF THE INVENTION

Figure 1:
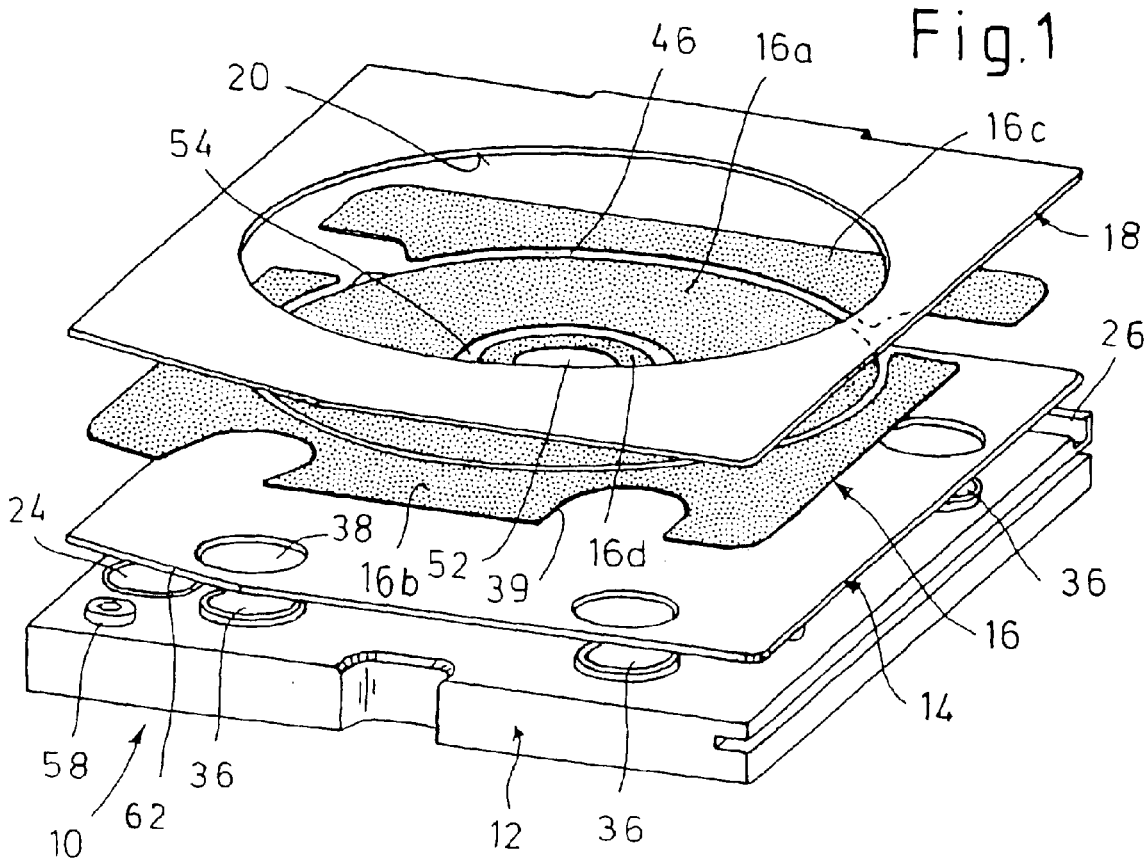
FIG. 1 is a diagrammatic perspective view of an embodiment of the holder according to the invention which is preferred at the present time, with the individual mutually parallel parts being illustrated in an exploded view.

Before looking at the structures shown in detail in the drawings, it will be noted that the holders indicated generally by reference numeral 10 therein are suitable for printing on CDs, CD-cards, chip cards and other articles which are normally of a thickness which is small in relation to their surface extent.

Figure 2:
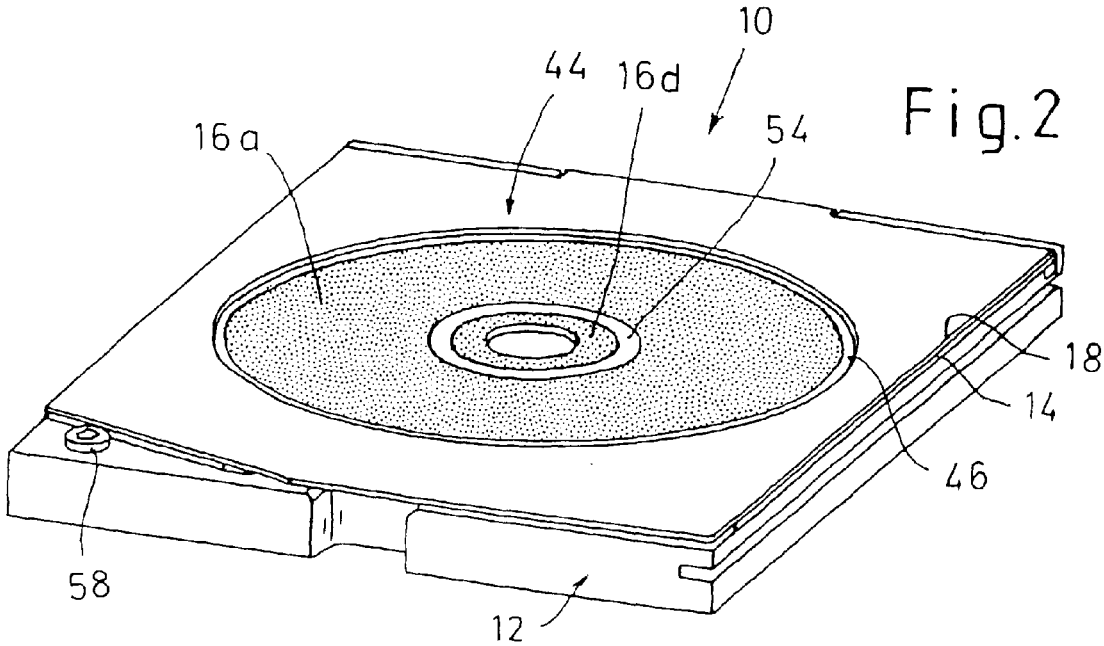
FIG. 2 is a perspective view generally corresponding to FIG. 1 but with the individual parts thereof in their operative position of assembly.
Figure 9:
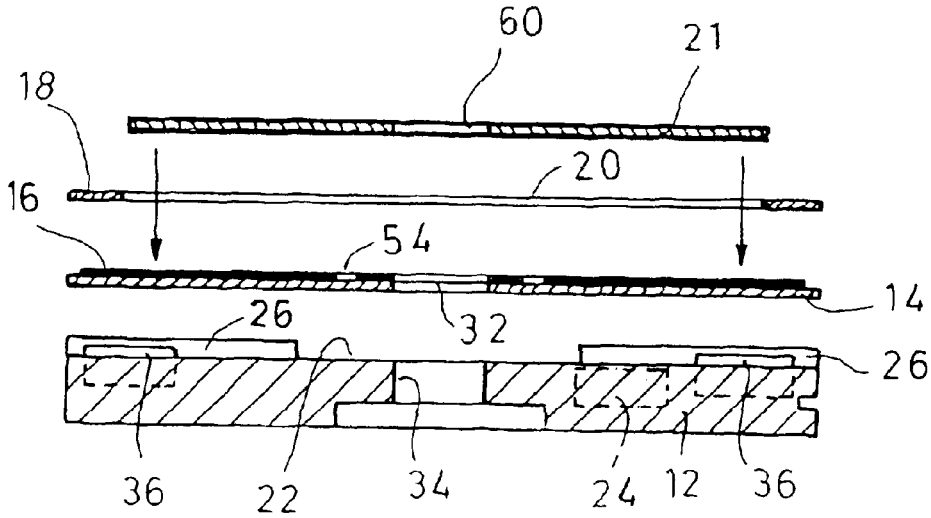
FIG. 9 is a view in section taken along line IX—IX in FIG. 8 of the entire holder with an article but in an exploded view with the parts, with the exception of the intermediate plate and the film, shown at a spacing from each other.

Referring first to FIGS. 1 and 2, shown therein is a holder for use in a machine for decorating or printing on articles, for holding such an article, which substantially comprises a base member 12 in the general form of a plate, an intermediate plate 14 which rests on the base member 12 and to the surface of which, that is remote from the base member 12, there is fitted a multi-part adhesive film 16 forming a layer of soft material, and a format plate 18 provided with an opening 20, in the form of a round hole in this embodiment, the shape and size of the opening 20 being suitably matched to the shape and size of an article to be decorated as indicated at 21 in FIG. 9. The film 16 in the form of a layer of soft material is of such a softness as to serve the purposes referred to hereinbefore, namely suitably supporting the article 21 which rests thereon for the decoration procedure, while being sufficiently soft to allow particles, such as dust and the like which come between the layer of soft material and the article resting thereon, to be suitably pressed into the film, so that the article will not be damaged as by scratching.

In the illustrated embodiment the upper boundary surface of the base member 12, as indicated at 22 in FIG. 3, is of a substantially flat nature so that the lower boundary surface of the intermediate plate 14, which is also flat, bears closely and snugly on the upper surface 22 of the base member 12.

Two first magnets 24 are set into the base member 12 in such a way that their surfaces, which face towards the intermediate plate 14, are aligned with the upper surface 22 of the base member 12. When the intermediate plate 14 is in the condition of resting on the base member 12 and the magnets 24, the intermediate plate 14, which comprises magnetizable material, is held in position by the two permanent magnets 24. In order to easily determine the position of the intermediate plate 14 on the base member 12, the base member 12, at one of its two lateral boundaries which is shorter than the other two lateral boundaries extending perpendicularly thereto, is provided with a bar-shaped projection 26, which projects upwardly with respect to the upper surface 22 of the base member 12 and which has an opening as indicated at 28 in FIG. 3, into which a tongue-shaped projection, indicated at 30 in FIG. 6, on the intermediate plate 14 engages when the intermediate plate 14 assumes its desired or reference position on the base member 12, that position being characterized, inter alia, by a central opening 32 in the intermediate plate 14 being aligned with a corresponding opening 34 in the base member 12. The tongue-like projection 30 is of such a size that it engages with a close fit into the opening 28 in the bar-shaped projection 26.

Figure 7:
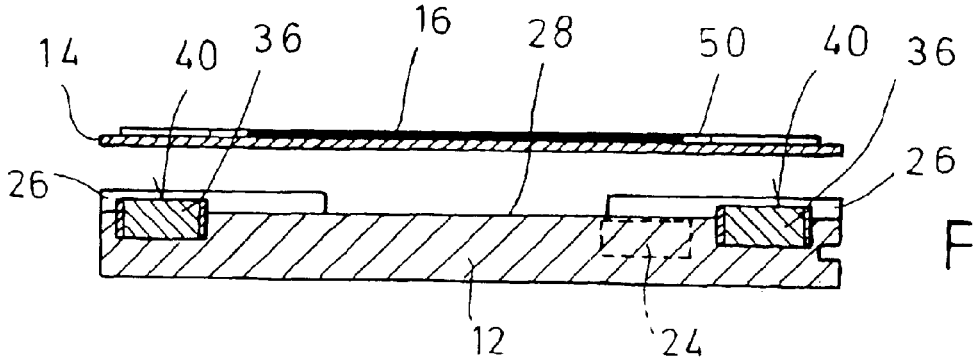
FIG. 7 is a view in section taken along line VII—VII in FIG. 6, but in an exploded view with the intermediate plate at a spacing above the base member.

The base member 12 is further provided with four second magnets, which can be most clearly seen at 36 in FIG. 3, but which project beyond the upper surface 22 of the base member 12 by a distance which is approximately the same as the thickness of the intermediate plate 14 with the film 16 adhering thereto. The magnets 36 engage into holes, shown at 38 in FIG. 1, in the intermediate plate 14 and recesses, shown at 39 in FIG. 1 in the film 16, in such a way that the upper boundary surfaces, designated by references 40 in FIG. 7, on the magnets 36 approximately align with the upper surface of the film 16 which is fixed by adhesive on the intermediate plate 14.

Figure 8:
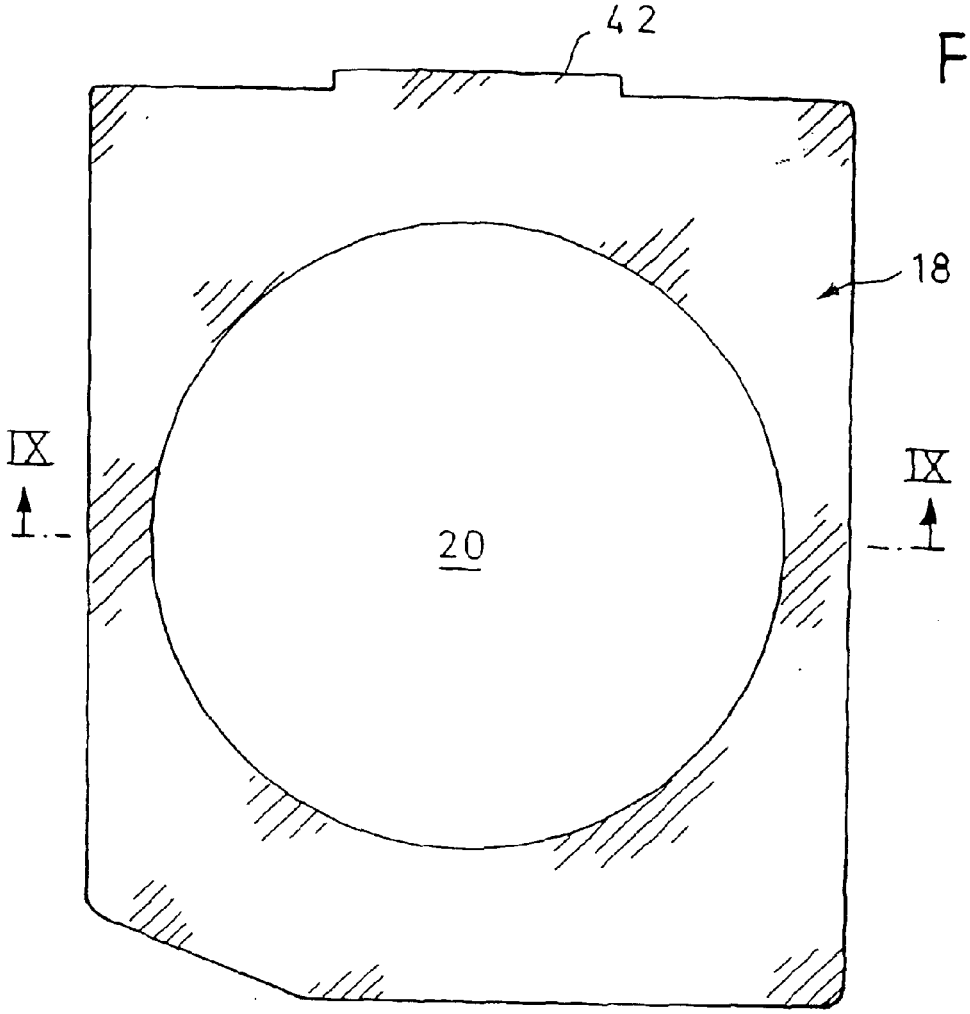
FIG. 8 is a plan view of a format plate of the holder of FIGS. 1 and 2.

The format plate 18, which also comprises magnetizable material, rests on the film 16 and the second magnets 36 and is held in position by the latter. The format plate 18 is also provided with a tongue-shaped projection, designated by reference 42 in FIG. 8, which, similarly to the projection 30 on the intermediate plate 14, also extends in the plane of the respective plate. Also similarly to the projection 30 on the intermediate plate 14, the projection 42 on the format plate 18 engages with a close fit into the opening 28 in the bar-shaped projection 26, in order to thereby fix the position of the format plate 18 relative to the base member 12 and relative to the intermediate plate 14. The format plate 18, in the embodiment illustrated herein, is flat at top and bottom thereof.

Looking now more particularly at FIG. 2, the opening 20 in the format plate 18, together with the portion 16*a* of the adhesive film 16, which is below the format plate 18 and is visible through the central region thereof and adheres to the intermediate plate 14, forms a receiving means 44 for the article to be printed upon, for example a CD, as indicated at 21 in FIG. 9. Besides the central portion 16*a*, the film 16 has three further portions as shown at 16*b*, 16*c* and 16*d* in FIG. 6. The central portion 16*a*, on the one hand, and the other two portions 16*b*, 16*c*, on the other hand, are separated from each other by a substantially annular opening indicated at 46 in FIG. 6. The opening 46 is arranged in such a way that, when the holder 10 is assembled, the opening 46 extends along the boundary of the opening 20 in the format plate 18 and thus substantially along the outer periphery of an article 21 accommodated in the receiving means 44. The opening 46, with the upper boundary surface 48, forms a groove 50 (see FIG. 7) which, for example in the case of a round CD disposed in the receiving means 44, extends substantially along the peripheral edge of the CD, which edge, particularly in the case of a CD produced by means of injection molding, may have sharp-edged projections, burrs or the like which, if a film were also arranged in the region of the groove 50, could damage same. The groove corresponding to the opening 46 thus represents a free space into which sharp-edged projections, burrs or the like of that kind can project without involving the risk of damage to any parts, more particularly the film 16, the central portion of which terminates at the inner periphery of the groove 50.

The two portions 16*b* and 16*c* of the film 16, which are outside the opening 46, are disposed, when the holder 10 is in the assembled condition, between the corresponding regions of the intermediate plate 14 and the format plate 18 respectively, that is to say outside the opening 20 provided in the latter. That affords the advantage that the format plate 18, which rests on the regions 16*b*, 16*c* of the film 16, is also displaced upwardly by the dimension corresponding to the thickness of the adhesive film 16, so that the presence of the film means that there is no change whatsoever in terms of the relationship between the position of the format plate, on the one hand, and the article in the receiving means 44, on the other hand. Both those parts, namely the article and the format plate, are arranged displaced upwardly by the thickness of the adhesive film 16. The thickness of the film 16 can be, for example, 0.35 mm. In addition, the above-described arrangement of the component parts makes it possible to use an intermediate plate which is flat at both sides and which is thus simple in terms of structure and also manufacture, wherein the intermediate plate can be of a thickness of, for example, 1.0 mm.

In addition, at a short radial distance from the central hole provided in the adhesive film 16, the hole being indicated at reference 52 in FIG. 1, the film 16 is provided with a further peripherally extending annular opening, as indicated at 54 for example in FIGS. 2 and 3. The opening 54, together with the corresponding annular portion of the boundary surface 48 of the intermediate plate 14, forms a groove or depression. That annular depression which is thus defined by the central film portion 16*a* and the film ring 16*d* delimiting the central hole 52 can accommodate, if necessary, any projections which may be found on the article to be accommodated in the receiving means 44 and which serve, for example, as a spacer so that the article is not prevented from resting snugly and closely on the film portions 16*a* and 16*d* in the remaining region of the receiving means 44. If necessary, the intermediate plate 14 can be provided along the annular opening 54 with a groove-shaped depression, if the dimensions of the projections on the articles require that.

Figure 6:
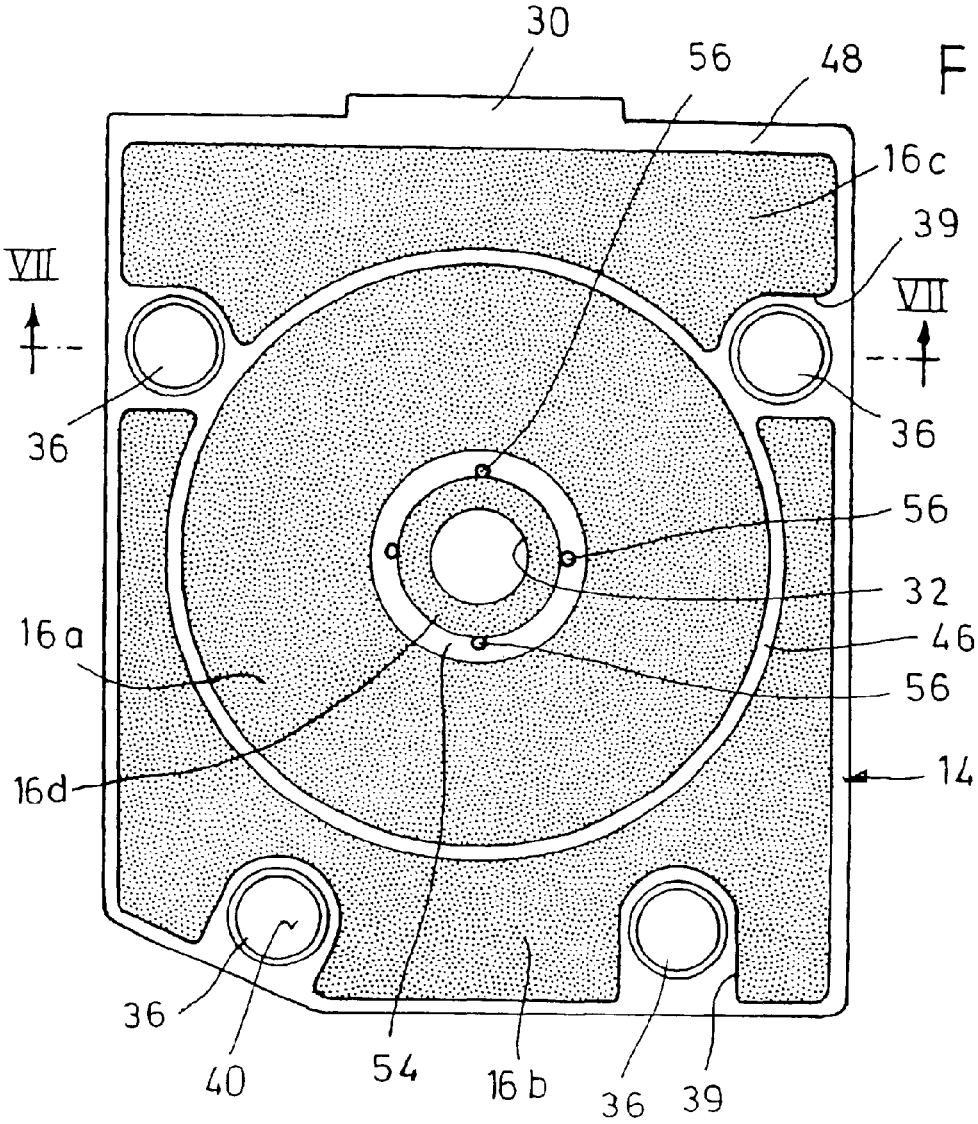
FIG. 6 is a plan view of the base member with an intermediate plate disposed thereon and provided with a layer of soft material.

Referring now to FIG. 6, reference 56 denotes passages which communicate with the depression formed by the annular opening 54 and the upper surface 48 of the intermediate plate 14. The passages 56 can be communicated with a suitable reduced-pressure source by way of further passages, indicated at 57 in FIG. 3, in the base member 12. The reduced pressure, which thereby acts on an article in the receiving means 44, provides that the article is secured in position for example during transportation thereof in the holder 10 through treatment stations of a machine for decorating or applying printing to the article, after the article has been previously properly aligned, for example in the station in which the article was introduced into the decorating or printing machine or in a subsequent station. The alignment procedure is implemented by a centering bar which will have been introduced through the opening 34 in the base member 12, the opening 32 in the intermediate plate 14, the central opening in the film 16, and the opening 60 in the article 21 itself.

The central film portion 16*a*, which fills up the substantial part of the receiving means 44, and the film ring 16*d*, which extends around the central opening 52, in particular by virtue of their elastic flexibility, in conjunction with the lower surface of the article which rests on the film portions, provide for a sealing effect in respect of the groove-shaped depression defined by the opening 54, so that the reduced pressure which acts on the article to secure it in place can be maintained without causing any real difficulty.

Advantageously, the arrangement is such that the format plate 18 is of smaller thickness than the article such as the CD 21, so that the surface of the article which is to be decorated or printed upon is disposed at a higher level than the upward surface of the format plate 18 so that, when using for example offset printing, there is no danger of the impression cylinder coming into contact with the upper surface of the format plate 18. The thickness of the format plate 18 can be, for example, 0.6 mm.

The operation of fitting the adhesive film 16, which in this embodiment comprises a plurality of portions, to the intermediate plate 14, can be effected in a simple manner by a procedure whereby the portions of the adhesive film 16 are arranged on a carrier or backing film, in the relationships corresponding to their subsequent arrangement on the intermediate plate 14, so that the portions of the self-adhesive film 16 can then be transferred from the carrier film onto the intermediate plate in the usual way in a single working operation.

Reference will now be directed to FIGS. 1 and 2 which, in particular, show that the base member 12 is provided at its top side, as indicated at 22, with an eccentric member 58 which is mounted on the base member 12 rotatably about an axis which is perpendicular to the main plane of the base member 12. It will be seen that the intermediate plate 14 and the format plate 18 are each provided with an inclined surface or bevel 62, so that the edge region of the base member 12, on which the eccentric member 58 is supported, remains free. The eccentric member 58, the thickness of which approximately corresponds to the total thickness of the intermediate plate 14, the adhesive film 16 thereon and the format plate 18, is arranged in such a way that, in a given angular position about its axis of rotation, it bears against the lateral inclined edge surface 62 of the intermediate plate 14 and clamps it in its position as determined by the two bar projections 26 at the opposite side of the base member 12.

Preferably, the arrangement here is such that, in this case, there is a small amount of play between the eccentric member 58 and the format plate 18, such play on the one hand ensuring that the format plate does not become jammed, while on the other hand permitting it only a quite small freedom of motion, if any at all, which in any case can be only minimal by virtue of the positively locking connection afforded between the format plate 18 and the bar-shaped projection 26.

For the purposes of replacing the format plate 14 with the film 16 thereon, it is only necessary to rotate the eccentric member 58 to such an extent that the above-mentioned clamping action, whereby the plate is pressed against the bar-shaped projection 26, is removed. The two plates can then be removed from the base member 12, against the force of the magnets 24 and 36 respectively. Fitting an intermediate plate 14 with a fresh film 16 thereon and optionally a fresh format plate is implemented in a similarly simple fashion. The two plates are disposed on the base member 12 in the above-described sequence as can be clearly seen from the drawings, in such a way that the respective tongue-shaped extensions 30 and 42 respectively engage into the opening 28 in the projection 26. All that is then required is a rotary movement of the eccentric member 58 to make the holder 10 ready for operation again, by securing the plates in position on the base member 12. When the two plates 14 and 18 are positioned in that way, they are also simultaneously fixed in place by the respective permanent magnets 24 and 36 so that no special steps or measures are required for that purpose.

Figure 10:
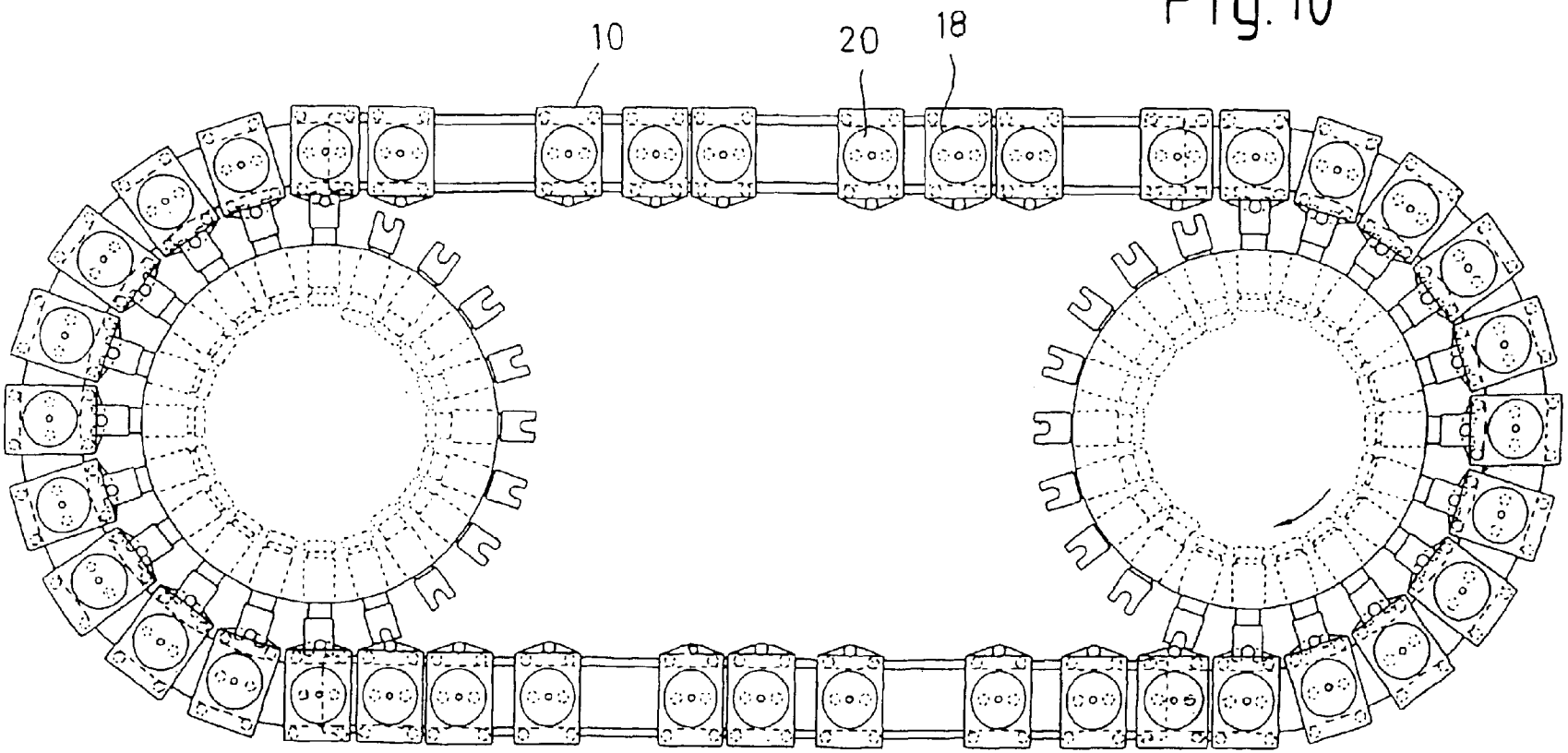
FIG. 10 is a diagrammatic plan view of a transport system in a machine for decorating articles with more than thirty holders.

Reference will now be made to FIG. 10 showing, in highly diagrammatic form, the structure of an embodiment of a machine for decorating or applying printing to articles by means of screen printing and offset printing, although the printing stations are not shown for the sake of enhanced clarity of the drawing. The illustrated machine is provided with more than thirty holders 10 as described hereinbefore, which are suitable in particular for CDs and which circulate through the respective stations of the machine on an endless conveyor belt.

It will be seen therefore from the foregoing that the holder according to the invention has an additional intermediate plate which if necessary can be removed from the holder in order to fit the intermediate plate with a fresh layer of soft material, in which respect the operation of removing the used or worn layer from the intermediate plate 18 and the operation of fitting a fresh layer to the intermediate plate 18 can be implemented outside the machine, so that operation of the machine normally remains unaffected by the procedure for replacing the layer of soft material, if the format plate has to be replaced in any case. At any event, the amount of time required for replacing the layer of soft material is negligible if two intermediate plates 18 are kept available for each holder, and they can thus be used in alternate succession.

The advantages which can be achieved by the invention will become even more apparent if consideration is given as an alternative to the possibility of using a holder without an intermediate plate, in which case each holder has to be replaced in its entirety in order to change the layer of soft material on which the respective article rests. That would require first releasing each individual holder from a guide and/or transport element carrying it, removing it therefrom and then fitting a new holder thereto. That would involve substantially more time than simply changing the intermediate plate 18 in accordance with the invention. In addition, this theoretical alternative would presuppose the provision and inventory of a correspondingly large number of holders, which in turn would entail considerably higher cost levels in terms of capital investment and inventory.

It will be appreciated that the operation of changing the layer of soft material in the form of the film 16 can be implemented in an extremely short period of time, if an intermediate plate 14 with the fresh layer of soft material thereon is already available and ready for fitment at the time of the change procedure being effected. In that case, at least two intermediate plates 14 would be required for each holder. It will be appreciated, however, that the increase in expenditure that this entails is very low, as the intermediate plates 14 can be simple sheet metal portions which are inexpensive to manufacture so that, even in the case of printing machines and decorating machines and the like which have numerous holders, a considerable economic advantage is still at any event achieved by virtue of the reduction in machine stoppage times.

However, even if there is only one intermediate plate available for each holder, the invention still affords the advantage of simplicity of operation in terms of changing the layer of soft material for supporting an article in each holder, as it will normally be easier for the operations which are linked to changing the layers of soft material, that is to say removing the film 16 to be replaced, cleaning residues of adhesive off the intermediate plate 14 and fitting a new film 16 to the cleaned intermediate plate 14, to be implemented when the holder is out of the machine, than on a holder which is still fitted in the machine.

It will be appreciated by those skilled in the art that the above-described embodiment of the invention has been set forth solely by way of example and illustration of the principles of the present invention and that various modifications and alterations may be made therein without thereby departing from the spirit and scope of the invention as defined by the appended claims.

We claim:

1. A holder for use in a machine for decorating articles for holding an article, the holder comprising a base member mountable on a transport system in the machine, a format plate arranged releasably over the base member and having an opening for receiving an article, rapidly insertable and rapidly releasable intermediate plate arranged between the base member and the format plate and having a surface remote from the base member, and a thin layer of soft material for supporting the article thereon, the layer being mounted on the remote surface of the intermediate plate.

2. The holder as set forth in claim 1, wherein the layer is a flexible film on the intermediate plate.

3. The holder as set forth in claim 1, wherein the layer is glued to the intermediate plate.

4. The holder as set forth in claim 1, wherein the layer is elastically yielding.

5. The holder as set forth in claim 1, wherein the layer comprises plastic material.

6. The holder as set forth in claim 5, wherein the plastic material comprises polyurethane.

7. The holder as set forth in claim 1, further comprising at least one magnet on the base member for holding the intermediate plate to the base member.

8. The holder as set forth in claim 1, further comprising at least one magnet on the base member, wherein the intermediate plate has openings through which the at least one magnet extends for holding the format plate to the intermediate plate.

9. The holder as set forth in claim 8, wherein the layer is provided with openings through which the at least one magnet extends.

10. The holder as set forth in claim 8, wherein the layer is provided with recesses through which the at least one magnet extends.

11. The holder as set forth in claim 1, wherein the layer comprises a plurality of portions including at least a central portion associated with the region defined by the opening in the format plate and at least one further portion between the intermediate plate and the format plate.

12. The holder as set forth in claim 11, wherein the central portion of the layer is subdivided in such a way that a first annular disk of soft material is arranged in concentric relationship with a central hole in the intermediate plate, the first annular disk being surrounded by a wider second annular disk of soft material in concentric relationship with the first annular disk, leaving an annular spacing from the first annular disk.

13. The holder as set forth in claim 12, wherein the second annular disk terminates at a small spacing from the outer boundary of the article-receiving opening in the format plate, in such a way that along the outer periphery of the receiving opening there is an annular surface of the intermediate plate not covered by the layer.

14. The holder as set forth in claim 13, wherein the base member and the intermediate plate are each provided with at least one hole, and the holes are in at least partially mutually overlapping relationship and are connectable through the hole in the base member to a reduced-pressure source.

15. The holder as set forth in claim 14, wherein the at least one hole in the intermediate plate at the side thereof remote from the base member opens in the annular spacing of the intermediate plate between the first annular disk and the second annular disk.

16. The holder as set forth in claim 1, further comprising means for fixing the intermediate plate in its operative position.

17. The holder as set forth in claim 16, wherein the means for fixing the intermediate plate in its operative position comprises on the base member a displaceable element which in an operative position thereof clamps the intermediate plate in its the operative position.

18. The holder as set forth in claim 17, wherein the displaceable element comprises an eccentric carried by the base member and rotatable about an axis perpendicular to a main plane of the base member, the eccentric in its operative position bearing against the intermediate plate for clamping the intermediate plate in its operative position.

19. A method for renewing the thin layer of soft material in the holder of claim 1 in a machine for decorating articles, the method comprising the steps of:

removing from the holder the intermediate plate with the layer to be renewed, and fitting an intermediate plate with a new layer in the holder.

20. An apparatus for decorating articles including at least one holder as set forth in claim 1.

* * * * *